US005714942A

United States Patent [19]

Buchanan

[11] Patent Number: 5,714,942

[45] Date of Patent: Feb. 3, 1998

[54] ALARM SYSTEM FOR INDICATING THE REMOVAL OF PLUG FROM A RECEPTACLE

[76] Inventor: Shannon R. Buchanan, 456 W. Oak Ave., Robesonia, Pa. 19551

[21] Appl. No.: 742,742

[22] Filed: Nov. 1, 1996

[51] Int. Cl.[6] ..... G08B 21/00

[52] U.S. Cl. ..... 340/686; 340/687; 340/568; 340/571; 340/691; 340/693

[58] Field of Search ..... 340/568, 571, 340/687, 686, 693, 691

[56] References Cited

U.S. PATENT DOCUMENTS

| | | | |
|---|---|---|---|
| 3,192,518 | 6/1965 | Sliman | 340/568 |
| 3,484,775 | 12/1969 | Cline | 340/568 |
| 4,002,397 | 1/1977 | Wang et al. | 340/568 |
| 4,028,691 | 6/1977 | Zeder | 340/568 |
| 4,037,223 | 7/1977 | Tucci et al. | 340/568 |
| 4,157,542 | 6/1979 | Smith | 340/568 |
| 4,195,290 | 3/1980 | Magil et al. | 340/568 |
| 5,418,521 | 5/1995 | Read | 340/568 |

*Primary Examiner*—Jeffery Hofsass
*Assistant Examiner*—Benjamin C. Lee

[57] ABSTRACT

An alarm system for indicating the removal of a plug from a receptacle including an alarm adapted to actuate upon the receipt of an activation signal. Further provided is an actuation mechanism coupled between a power source and the alarm having a first orientation when a conventional plug is properly inserted within associated prong apertures of the electrical receptacle for precluding the transmission of the activation signal. The actuation mechanism further has a second orientation when a conventional plug is removed from the associated prong apertures of the electrical receptacle for allowing the transmission of the activation signal.

3 Claims, 3 Drawing Sheets

ALARM SYSTEM FOR INDICATING THE REMOVAL OF PLUG FROM A RECEPTACLE

BACKGROUND OF THE INVENTION

1. Field of the Invention

The present invention relates to an alarm system for indicating the removal of a plug from a receptacle and more particularly pertains to both alerting a guardian and deterring a child from a proximate area when a plug is removed from a receptacle.

2. Description of the Prior Art

The use of receptacle alarm assemblies is known in the prior art. More specifically, receptacle alarm assemblies heretofore devised and utilized for the purpose of indicating the removal of a electric plug from an assembly are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,258,744 to Zeder; U.S. Pat. No. 4,855,719 to Posey; U.S. Pat. No. 4,736,195 to McMurtry et al; U.S. Pat. No. 5,297,973 to Gorman; U.S. Pat. No. 4,935,725 to Turnau; and U.S. Pat. Des. 355,890 to Lentz.

In this respect, the alarm system for indicating the removal of a plug from a receptacle according to the present invention substantially departs from the conventional concepts and designs of the prior art, and in so doing provides an apparatus primarily developed for the purpose of both alerting a guardian and deterring a child from a proximate area when a plug is removed from a receptacle.

Therefore, it can be appreciated that there exists a continuing need for a new and improved alarm system for indicating the removal of a plug from a receptacle which can be used for both alerting a guardian and deterring a child from a proximate area when a plug is removed from a receptacle. In this regard, the present invention substantially fulfills this need.

SUMMARY OF THE INVENTION

In view of the foregoing disadvantages inherent in the known types of receptacle alarm assemblies now present in the prior art, the present invention provides an improved alarm system for indicating the removal of a plug from a receptacle. As such, the general purpose of the present invention, which will be described subsequently in greater detail, is to provide a new and improved alarm system for indicating the removal of a plug from a receptacle which has all the advantages of the prior art and none of the disadvantages.

To attain this, the present invention essentially comprises a housing with a front face, a rear opening, and a pair of side faces bevelled outwardly between the front face and the rear opening. As shown in FIG. 1, the front face has two sets of apertures each including a pair of spaced horizontally aligned rectangular prong apertures. A circular ground aperture is centered between and below the prong apertures. Further provided is a circular alarm button aperture horizontally aligned with and situated between the rectangular prong apertures. Formed on a rear surface of the front face on opposite sides of the rectangular prong apertures are a pair of threaded screw holes. The sets of apertures include a first set of apertures situated above a second set of apertures, as is conventional in art of wall mounted receptacles. For alarm purposes, a speaker is situated on a top side face of the housing, a shown in FIGS. 1–2. In use, the speaker is adapted for emitting an audible alarm upon the receipt of an activation signal. Also included are two pairs of alarm contacts. See FIG. 5. Each contact includes a semicircular strip with a rectangular strip integrally coupled to an outer edge thereof. A pair of contacts are coupled to the rear surface of the front face on diametrically opposite sides of each alarm button aperture. A battery is coupled between the contacts and the speaker via a plurality of wires. As best shown in FIGS. 3 and 4, an alarm button mounting plate is included with a planar rectangular periphery with a size corresponding to that of the front face of the housing. A set of apertures are formed therein for allowing the screwable coupling thereof with the threaded screw holes of the housing. The mounting plate further has a pair of cubic units situated about the sets of apertures. Each unit includes a central compartment with a post having primary bore. Such primary bore has a first diameter formed therein in coaxial relationship with an associated alarm button aperture. A secondary bore with a second diameter less than the first diameter is formed in coaxial relationship with the primary bore, wherein the secondary bore extends below the primary bore. For allowing the passage of prong strips between the prong apertures and the rear opening of the housing, the mounting plate further has a top prong compartment. A bottom ground compartment is provided for allowing the passage of a ground strip between the ground aperture and the rear opening of the housing. In use, the prong strips and ground strip allow coupling with a conventional electric receptacle and further allow the insertion of conventional electric plugs in the prong and ground apertures of the front face of the housing in electric communication with an associated receptacle. Finally, an alarm button assembly is included with a post having an annular metal flange coaxially coupled thereto adjacent a first end thereof. The post has a diameter equal to the second diameter. As shown in FIG. 4, the post is situated within the bores with the first end thereof extending beyond the front face of the housing and second end thereof extending within a lower extent of the secondary bore. Associated therewith is a spring with a diameter equal to the first diameter, wherein the spring is situated about the post between the flange thereof and a bottom of the primary bore. By this structure, the metal flange has a first biased orientation with the metal flange distant the contacts when a conventional plug is properly inserted within associated prong and ground apertures. In the first biased orientation, the metal flange is adapted for precluding the transmission of the activation signal. When a conventional plug is removed from the associated prong and ground apertures, the metal flange further has a second unbiased orientation with the metal flange abutting the contacts, thereby allowing the transmission of the activation signal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved alarm system for indicating the removal of a plug from a receptacle which has all the advantages of the prior art receptacle alarm assemblies and none of the disadvantages.

It is another object of the present invention to provide a new and improved alarm system for indicating the removal of a plug from a receptacle which may be easily and efficiently manufactured and marketed.

It is a further object of the present invention to provide a new and improved alarm system for indicating the removal of a plug from a receptacle which is of a durable and reliable construction.

An even further object of the present invention is to provide a new and improved alarm system for indicating the removal of a plug from a receptacle which is susceptible of a low cost of manufacture with regard to both materials and labor, and which accordingly is then susceptible of low prices of sale to the consuming public, thereby making such alarm system for indicating the removal of a plug from a receptacle economically available to the buying public.

Still yet another object of the present invention is to provide a new and improved alarm system for indicating the removal of a plug from a receptacle which provides in the apparatuses and methods of the prior art some of the advantages thereof, while simultaneously overcoming some of the disadvantages normally associated therewith.

Still another object of the present invention is to both alert a guardian and deter a child from a proximate area when a plug is removed from a receptacle.

Lastly, it is an object of the present invention to provide a new and improved alarm system for indicating the removal of a plug from a receptacle including an alarm adapted to actuate upon the receipt of an activation signal. Further provided is an actuation mechanism coupled between a power source and the alarm having a first orientation when a conventional plug is properly inserted within associated prong apertures of the electrical receptacle for precluding the transmission of the activation signal. The actuation mechanism further has a second orientation when a conventional plug is removed from the associated prong apertures of the electrical receptacle for allowing the transmission of the activation signal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
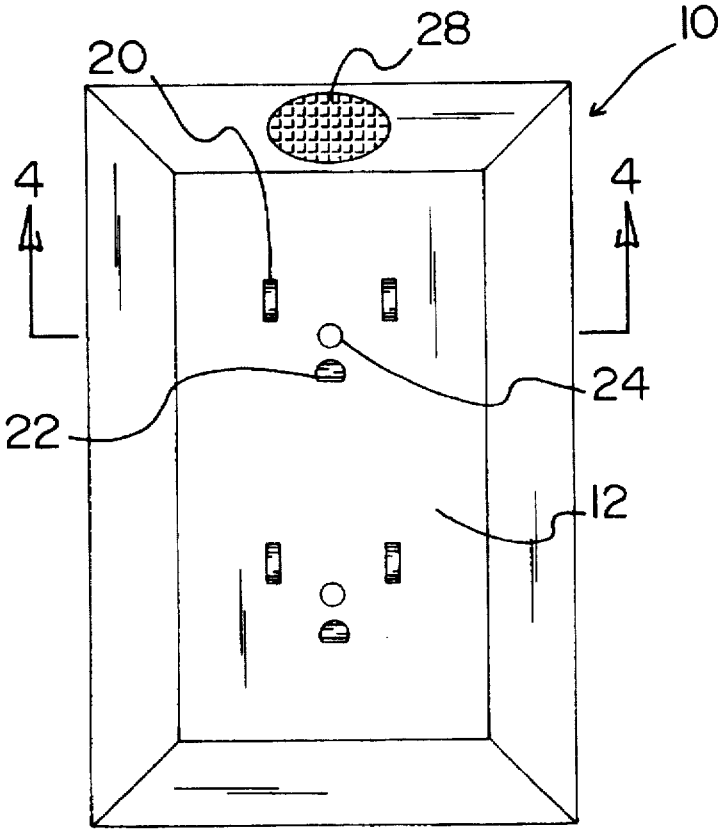
FIG. 1 is a perspective illustration of the preferred embodiment of the alarm system for indicating the removal of a plug from a receptacle constructed in accordance with the principles of the present invention.

With reference now to the drawings, and in particular to FIG. 1 thereof, a new and improved alarm system for indicating the removal of a plug from a receptacle embodying the principles and concepts of the present invention and generally designated by the reference numeral 10 will be described.

The present invention, the new and improved alarm system for indicating the removal of a plug from a receptacle, is comprised of a plurality of components. Such components in their broadest context include a housing, a speaker, a pair of contacts, a mounting plate, and an alarm button assembly. Such components are individually configured and correlated with respect to each other so as to attain the desired objective.

More specifically, it will be noted that the system 10 of the present invention includes a housing with a front face 12, a rear opening 14, and a pair of side faces 16 bevelled outwardly between the front face and the rear opening. As shown in FIG. 1, the front face has two sets of apertures 18 each including a pair of spaced horizontally aligned rectangular prong apertures 20. A circular ground aperture 22 is centered between and below the prong apertures. Further provided is a circular alarm button aperture 24. It is imperative that the circular alarm button be horizontally aligned with and situated between the rectangular prong apertures. Formed on a rear surface of the front face on opposite sides of the rectangular prong apertures are a pair of threaded screw holes 26. The sets of apertures include a first set of apertures situated above a second set of apertures, as is conventional in art of wall mounted receptacles.

Figure 2:
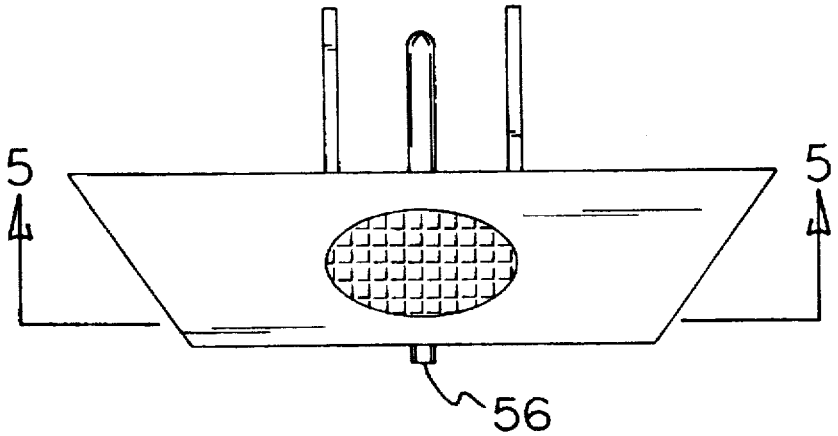
FIG. 2 is a side elevational view of the present invention.

For alarm purposes, a speaker 28 is situated on a top side face of the housing, a shown in FIGS. 1–2. In use, the speaker is adapted for emitting an audible alarm upon the receipt of an activation signal.

Figure 5:
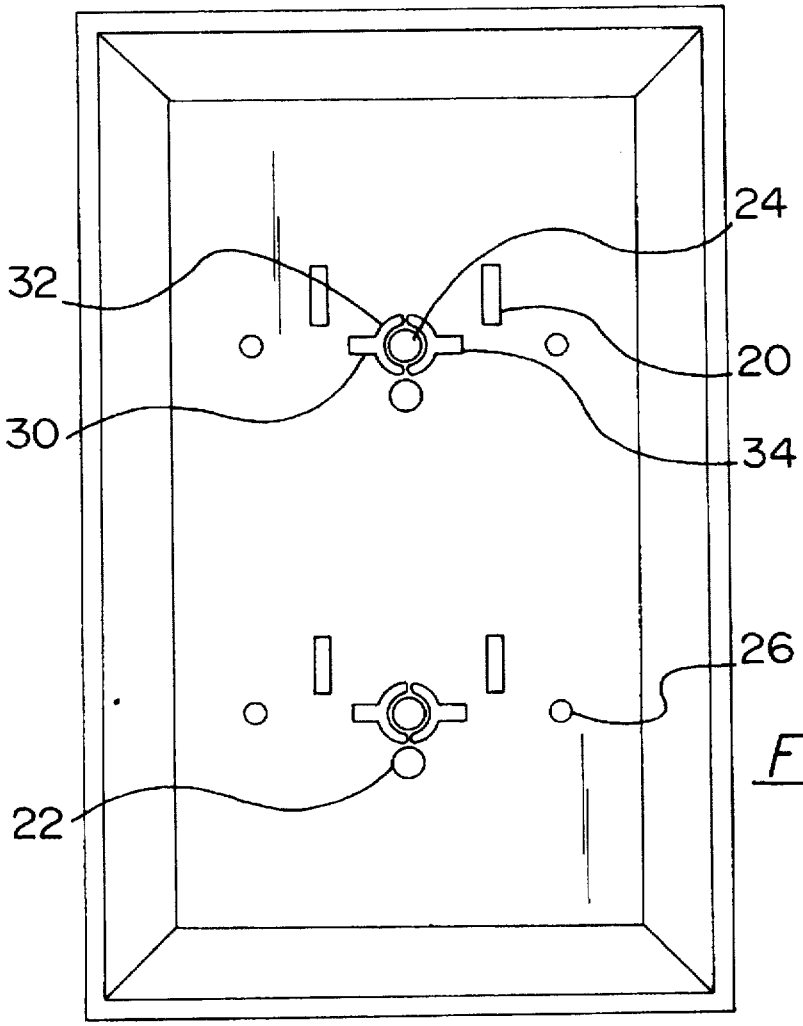
FIG. 5 is a rear elevational view of the rear opening of the present invention without the mounting plate installed.

Also included are two pairs of alarm contacts 30. See FIG. 5. Each contact includes a semicircular strip 32 with a rectangular strip 34 integrally coupled to an outer edge thereof. A pair of contacts are coupled to the rear surface of the front face on diametrically opposite sides of each alarm button aperture.

Figure 6:
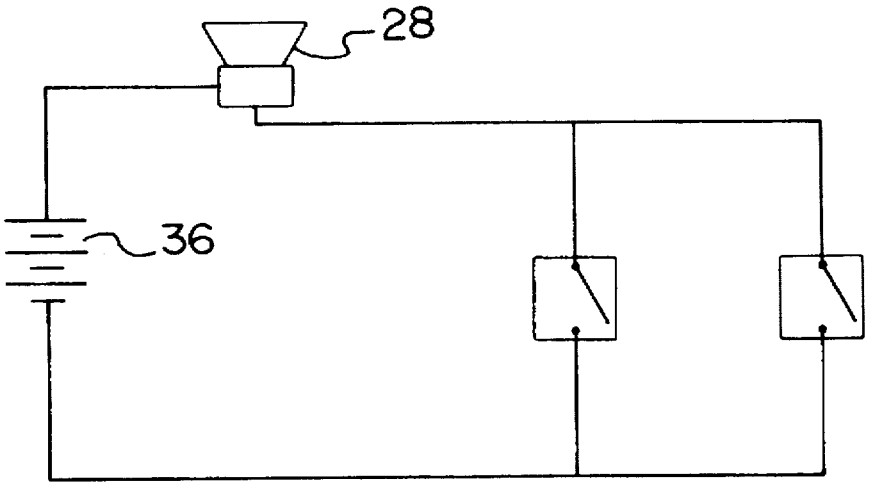
FIG. 6 is a schematic diagram depicting the electrical components of the present invention.

A battery 36 is coupled between the contacts and the speaker via a plurality of wires. It should be noted that each pair of contacts are connected in parallel, as shown in FIG. 6.

Figure 3:
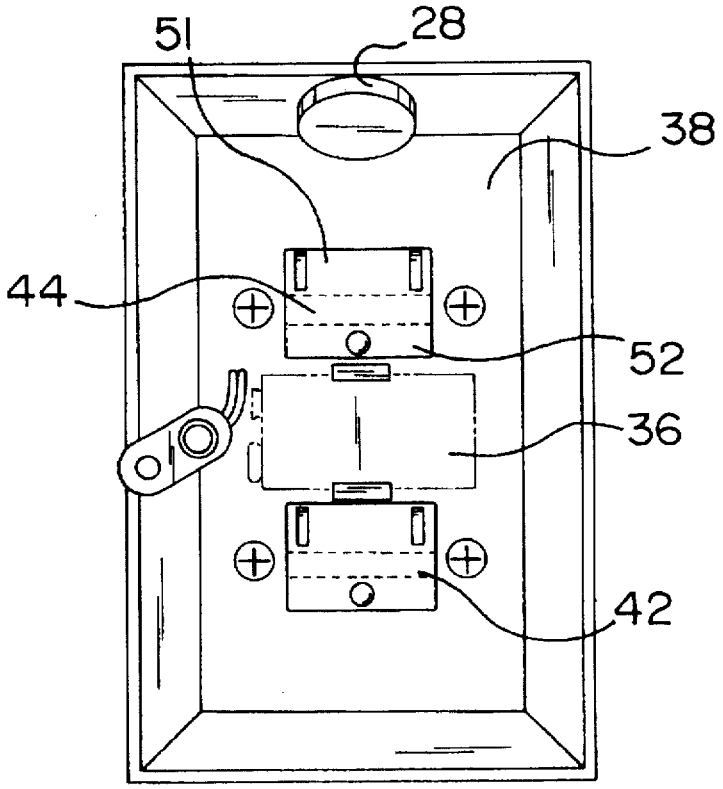
FIG. 3 is a rear elevational view of the rear opening of the present invention with the mounting plate installed.
Figure 4:
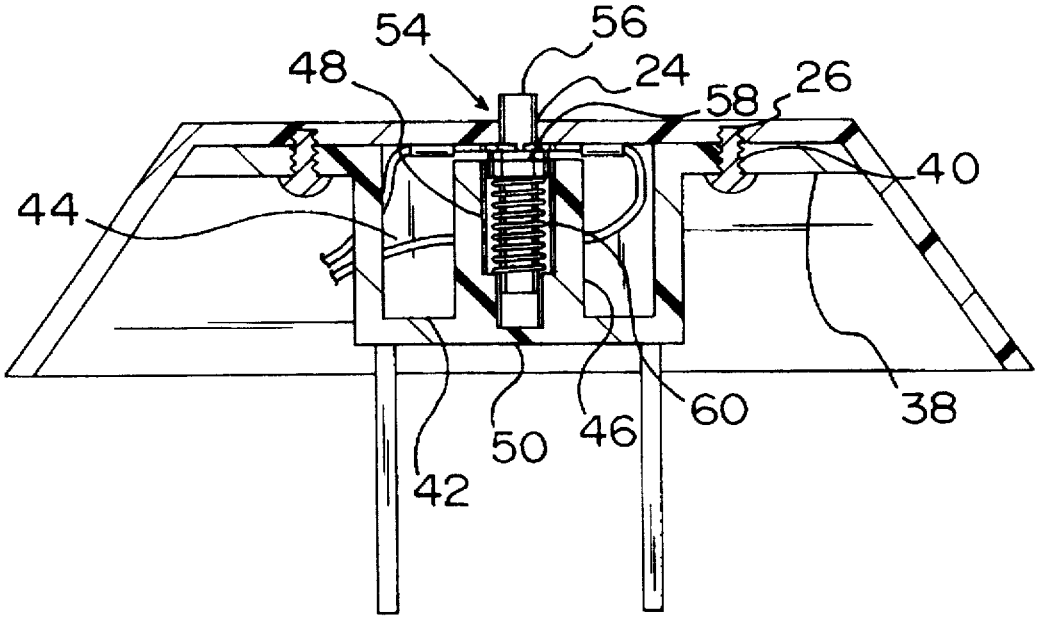
FIG. 4 is a cross-sectional view of taken along line 4—4 shown in FIG. 1.

As best shown in FIGS. 3 and 4, an alarm button mounting plate 38 is included with a planar rectangular periphery and a size corresponding to that of the front face of the housing. A set of apertures 40 are formed therein for allowing the screwable coupling thereof with the threaded screw holes of the housing. The mounting plate further has a pair of cubic units 42 situated about the sets of apertures. As shown in FIG. 3, a prong is extended from facing sides of the cubic units for containing the battery which preferably consists of a standard 9V battery. Each unit includes a central compartment 44 with a post 46 having primary bore 48. Such primary bore has a first diameter formed therein in coaxial relationship with an associated alarm button aperture. A secondary bore 50 with a second diameter less than the first diameter is formed in coaxial relationship with the primary bore, wherein the secondary bore extends below the primary bore. For allowing the passage of prong strips between the prong apertures and the rear opening of the housing, the mounting plate further has a top prong compartment 51. A bottom ground compartment 52 is provided for allowing the passage of a ground strip between the ground aperture and the rear opening of the housing. The top and bottom compartment utilize conventional connection methods and further preclude connection between the prongs and ground wiring of a house with the speaker, contacts, and battery. In use, the prong strips and ground strip allow coupling with a conventional electric receptacle and further allow the insertion of conventional electric plugs in the prong and ground apertures of the front face of the housing in electric communication with an associated receptacle.

Finally, an alarm button assembly 54 is included with a post 56 having an annular metal flange 58 coaxially coupled thereto adjacent a first end thereof. The post has a diameter equal to the second diameter. As shown in FIG. 4, the post is situated within the bores with the first end thereof extending beyond the front face of the housing and second end thereof extending within a lower extent of the secondary bore. Associated therewith is a spring 60 with a diameter equal to the first diameter, wherein the spring is situated about the post between the flange thereof and a bottom of the primary bore. By this structure, the metal flange has a first biased orientation with the metal flange distant the contacts when a conventional plug is properly inserted within associated prong and ground apertures. In the first biased orientation, the metal flange is adapted for precluding the transmission of the activation signal. When a conventional plug is removed from the associated prong and ground apertures, the metal flange further has a second unbiased orientation with the metal flange abutting the contacts, thereby allowing the transmission of the activation signal.

As an option, a plurality of conventional prong covers are included. Although such covers are not illustrated, they comprise of a planar member and a pair of spaced plastic prongs extending therefrom for engaging the prong apertures of an unused set of apertures, thereby precluding the actuation of the speaker if a receptacle is currently not being used.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A alarm system for indicating the removal of a plug from a receptacle comprising, in combination:

a housing with a front face, a rear opening, and a pair of side faces, the front face having two sets of apertures each including a pair of spaced horizontally aligned rectangular prong apertures, a circular ground aperture centered between and below the prong apertures, a circular alarm button aperture horizontally aligned with and situated between the rectangular prong apertures, and a pair of threaded screw holes formed on a rear surface of the front face on opposite sides of the rectangular prong apertures, wherein a first set of apertures is situated above a second set of apertures;

a speaker for emitting an audible alarm upon the receipt of an activation signal;

two pairs of alarm contacts coupled to the rear surface of the front face on diametrically opposite sides of each alarm button aperture;

a battery coupled between the contacts and the speaker via a plurality of wires;

an alarm button mounting plate with a planar rectangular periphery with a size corresponding to that of the front face of the housing, the mounting plate further having a pair of units situated about the sets of apertures each including a central compartment with a post having primary bore with a first diameter formed therein in coaxial relationship with an associated alarm button aperture and a secondary bore with a second diameter less than the first diameter wherein the secondary bore extends below the primary bore, the mounting plate further including a top prong compartment for allowing the passage of prong strips between the prong apertures and the rear opening of the housing and further a bottom ground compartment for allowing the passage of a ground strip between the ground aperture and the rear opening of the housing, whereby the prong strips and ground strip allow coupling with a conventional electric receptacle and further allow the insertion of conventional electric plugs in the prong and ground apertures of the front face of the housing in electric communication with the conventional electrical receptacle; and an alarm button assembly including a second post with an annular metal flange coaxially coupled thereto adjacent a first end thereof, the second post having diameter equal to the second diameter wherein the second post is situated within the bores with the first end thereof extending beyond the front face of the housing and second end thereof extending within a lower extent of the secondary bore, the assembly including a spring with a diameter equal to the first diameter wherein the spring is situated about the post between the flange thereof and a bottom of the primary bore, whereby the metal flange has a first biased orientation with the metal flange distant the contacts when a conventional plug is properly inserted within associated prong and ground apertures for precluding the transmission of the activation signal and a second unbiased orientation with the metal flange abutting the contacts when a conventional plug is removed from the associated prong and ground apertures for allowing the transmission of the activation signal.

2. A new and improved alarm system for indicating the removal of a plug from a receptacle comprising, in combination:

a housing with a front face, a rear opening, and a pair of side faces bevelled outwardly between the front face and the rear opening, the front face having two sets of apertures each including a pair of spaced horizontally aligned rectangular prong apertures, a circular ground aperture centered between and below the prong apertures, a circular alarm button aperture horizontally aligned with and situated between the rectangular prong apertures, and a pair of threaded screw holes formed on a rear surface of the front face on opposite sides of the rectangular prong apertures, wherein a first set of apertures is situated above a second set of apertures;

a speaker situated on a top side face of the housing for emitting an audible alarm upon the receipt of an activation signal;

two pairs of alarm contacts wherein each contact includes a semicircular strip with a rectangular strip integrally coupled to an outer edge thereof, wherein a pair of contacts are coupled to the rear surface of the front face on diametrically opposite sides of each alarm button aperture;

a battery coupled between the contacts and the speaker via a plurality of wires;

an alarm button mounting plate with a planar rectangular periphery with a size corresponding to that of the front face of the housing and a set of apertures for allowing the screwable coupling thereof with the threaded screw holes of the housing, the mounting plate further having a pair of cubic units situated about the sets of apertures each including a central compartment with a post having primary bore with a first diameter formed therein in coaxial relationship with an associated alarm button aperture and a secondary bore with a second diameter less than the first diameter wherein the secondary bore extends below the primary bore, the mounting plate further including a top prong compartment for allowing the passage of prong strips between the prong apertures and the rear opening of the housing and further a bottom ground compartment for allowing the passage of a ground strip between the ground aperture and the rear opening of the housing, whereby the prong strips and ground strip allow coupling with a conventional electric receptacle and further allow the insertion of conventional electric plugs in the prong and ground apertures of the front face of the housing in electric communication with the conventional electrical receptacle; and an alarm button assembly including a second post with an annular metal flange coaxially coupled thereto adjacent a first end thereof, the second post having a diameter equal to the second diameter wherein the second post is situated within the bores with the first end thereof extending beyond the front face of the housing and second end thereof extending within a lower extent of the secondary bore, the assembly including a spring with a diameter equal to the first diameter wherein the spring is situated about the post between the flange thereof and a bottom of the primary bore, whereby the metal flange has a first biased orientation with the metal flange distant the contacts when a conventional plug is properly inserted within associated prong and ground apertures for precluding the transmission of the activation signal and a second unbiased orientation with the metal flange abutting the contacts when a conventional plug is removed from the associated prong and ground apertures for allowing the transmission of the activation signal.

3. An alarm system for indicating the removal of a plug from a receptacle comprising:

an electrical receptacle;

an alarm means including a speaker adapted to actuate upon the receipt of an activation signal;

a power source;

an actuation means coupled between the power source and the alarm means having a first orientation when a conventional plug is properly inserted within associated prong apertures of the electrical receptacle for precluding the transmission of the activation signal and a second orientation when a conventional plug is removed from the associated prong apertures of the electrical receptacle for allowing the transmission of the activation signal;

a housing with a front face, a rear opening, and a pair of side faces bevelled outwardly between the front face and the rear opening, the front face having two sets of apertures each including a pair of spaced horizontally aligned rectangular prong apertures, a circular ground aperture centered between and below the prong apertures, a circular alarm button aperture horizontally aligned with and situated between the rectangular prong apertures, and a pair of threaded screw holes formed on a rear surface of the front face on opposite sides of the rectangular prong apertures, wherein a first set of apertures is situated above a second set of apertures;

said actuation means including two pairs of alarm contacts wherein each contact includes a semicircular strip with a rectangular strip integrally coupled to an outer edge thereof, wherein a pair of contacts are coupled to the rear surface of the front face on diametrically opposite sides of each alarm button aperture;

said actuation means further including an alarm button mounting plate with a planar rectangular periphery with a size corresponding to that of the front face of the housing and a set of apertures for allowing the screwable coupling thereof with the threaded screw holes of the housing, the mounting plate further having a pair of cubic units situated about the sets of apertures each including a central compartment with a post having primary bore with a first diameter formed therein in coaxial relationship with an associated alarm button aperture and a secondary bore with a second diameter less than the first diameter wherein the secondary bore extends below the primary bore, the mounting plate further including a top prong compartment for allowing the passage of prong strips between the prong apertures and the rear opening of the housing and further a bottom ground compartment for allowing the passage of a ground strip between the ground aperture and the rear opening of the housing, whereby the prong strips and ground strip allow coupling with a conventional electric receptacle and further allow the insertion of conventional electric plugs in the prong and ground apertures of the front face of the housing in electric communication with the conventional electric receptacle;

wherein the actuation means further includes an alarm button assembly including a second post with an annular metal flange coaxially coupled thereto adjacent a first end thereof, the second post having a diameter equal to the second diameter wherein the second post is situated within the bores with the first end thereof extending beyond the front face of the housing and second end thereof extending within a lower extent of the secondary bore, the assembly including a spring with a diameter equal to the first diameter wherein the spring is situated about the post between the flange thereof and a bottom of the primary bore, whereby the metal flange has a first biased orientation with the metal flange distant the contacts when a conventional plug is properly inserted within associated prong and ground apertures for precluding the transmission of the activation signal and a second unbiased orientation with the metal flange abutting the contacts when a conventional plug is removed from the associated prong and ground apertures for allowing the transmission of the activation signal.

* * * * *